United States Patent [19]

Shibata et al.

[11] Patent Number: 5,058,541

[45] Date of Patent: Oct. 22, 1991

[54] VALVE OPERATING SYSTEM OF INTERNAL COMBUSTION ENGINE

[75] Inventors: Mitsuhiro Shibata; Toshiyasu Komatsu, both of Saitama, Japan

[73] Assignee: Honda Giken Kogyo Kabushiki Kaisha, Tokyo, Japan

[21] Appl. No.: 513,795

[22] Filed: Apr. 24, 1990

[30] Foreign Application Priority Data

Apr. 26, 1989 [JP] Japan ..... 1-106594

[51] Int. Cl.[5] ..... F01M 9/10

[52] U.S. Cl. ..... 123/90.37; 123/90.65; 277/140; 277/205

[58] Field of Search ..... 123/90.37, 90.65, 90.66, 123/90.67, 90.58; 277/140, 205

[56] References Cited

U.S. PATENT DOCUMENTS

| | | | |
|---|---|---|---|
| 2,716,401 | 8/1955 | Sietman | 123/188 R |
| 3,094,976 | 6/1963 | May | 123/90.67 |
| 3,120,221 | 2/1964 | Lyons | 123/90.14 |
| 3,885,546 | 5/1975 | Foley et al. | 123/90.37 |
| 4,368,699 | 1/1983 | Kodama | 123/90.67 |
| 4,408,770 | 10/1983 | Nemets et al. | 277/140 |
| 4,417,503 | 11/1983 | Izumi | 277/205 |
| 4,457,270 | 7/1984 | Kodama et al. | 123/90.58 |
| 4,662,325 | 5/1987 | Okabe et al. | 123/90.58 |
| 4,858,516 | 8/1989 | Klein | 277/205 |
| 4,928,644 | 5/1990 | Travis | 123/90.37 |

FOREIGN PATENT DOCUMENTS

| | | | |
|---|---|---|---|
| 1001332 | 2/1952 | France . | |
| 2529616 | 1/1984 | France | 123/90.14 |
| 2537207 | 6/1984 | France . | |
| 2102065 | 1/1983 | United Kingdom | 123/90.14 |

*Primary Examiner*—David A. Okonsky
*Assistant Examiner*—Weilun Lo
*Attorney, Agent, or Firm*—Lyon & Lyon

[57] ABSTRACT

A valve operating system for an internal combustion engine has an engine valve having a valve shaft portion and a valve body portion at an end tip of the valve shaft portion. The engine valve is supported on the body of the engine for opening and closing operations. A double cylindrical piston forms an air pressure chamber, with the air pressure biasing the valve in a valve closing direction. A driving member for driving the engine valve in a valve opening direction is operatively connected to the rear end of the valve shaft portion.

7 Claims, 5 Drawing Sheets

VALVE OPERATING SYSTEM OF INTERNAL COMBUSTION ENGINE

BACKGROUND OF THE INVENTION

In such a conventional system for example, as shown in Japanese Patent application Laid-open No. 36906/89, a valve spring is used for biasing the engine valve in a valve-closing direction, and the engine valve is driven in a valve-opening direction by the driving member against a spring force of the valve spring. However, in the conventional system using such a spring force, since there is a limit in the natural frequency of the valve spring, the operation of the engine valve corresponding to a high rotation of the engine may become difficult.

In another prior art design, an air spring is used for biasing the engine valve in the valve losing direction as shown in FIG. 6. In this prior art design, a bottomed cylindrical lifter 35 driven by a cam 40 is slidably fitted in a guide bore 36 provided in a body 1 of an engine and is abutted against a rear or stem end of a valve shaft portion 5*a* of an intake valve 5 or an exhaust valve. A piston 37 fixed to a mid-point of the valve shaft portion 5*a* is slidably fitted in a sleeve 39 with a front surface of the piston 37 being exposed to an air pressure chamber 38.

In this prior art design, since the intake valve 5 or the exhaust valve is biased in the valve-closing direction by the air pressure of the air pressure chamber 38 and so the resonance limit inherent to the natural frequency need not be taken account of, it is possible to drive the engine at a higher speed. However, the piston 37 is formed in a flat plate shape, and in order to secure a stroke of the piston 37 accompanying the opening and closing operations of the intake valve 5 or the exhaust valve, it is necessary to make the axial length of the sleeve 39 relatively long.

SUMMARY OF THE INVENTION

Accordingly, it is an object of the invention to provide a compact valve operating system of an internal combustion engine which enables the engine to be operated at a high speed.

In order to achieve the above object, one feature of the present invention resides in that a sleeve is fixed to the body of the engine. The sleeve has a bottomed sliding bore having at a bottom portion thereof a guide hole through which said valve shaft portion is air-tightly and movably passed, and a piston of a bottomed double cylindrical shape is fixed to a portion of the valve shaft portion close to the rear end thereof and is slidably fitted in said sliding bore through a seal member. A closed end of the piston axially faces outwardly so as to form an air pressure chamber between the piston and the bottom portion of the sliding bore.

Since a part of the air pressure chamber is formed within the piston, the axial length of the sleeve can be shortened, making a more compact structure.

The above and other objects, features and advantages of the present invention will become apparent from a reading of the following description of the preferred embodiments, taken in conjunction with the accompanying drawings.

BRIEF DESCRIPTION OF THE DRAWINGS

FIGS. 1 to 3 illustrate a first embodiment of the present invention, wherein FIG. 1 is a longitudinal sectional side view of a valve operating system of the first embodiment;

FIG. 2 is an enlarged longitudinal sectional view of a valve shaft seal member; and FIG. 3 is an enlarged view of a portion III in FIG. 1.

FIGS. 4 and 5 illustrate a second embodiment of the present invention, wherein FIG. 4 is a longitudinal sectional side view of a valve operating system of the second embodiment; and FIG. 5 is a view seen in the direction of the line V—V of FIG. 4.

DESCRIPTION OF THE PREFERRED EMBODIMENTS

Figure 1:
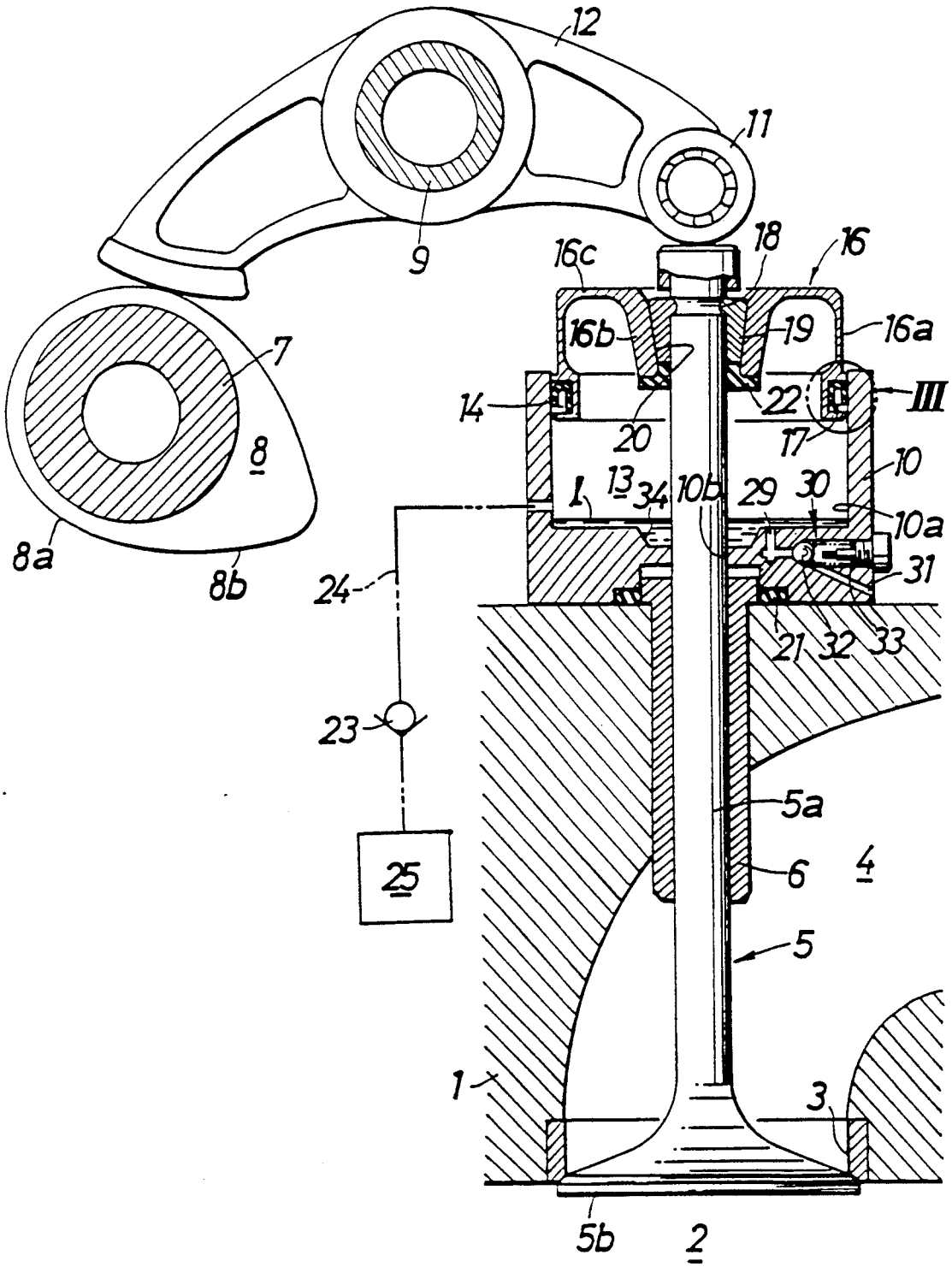
Figure 2:
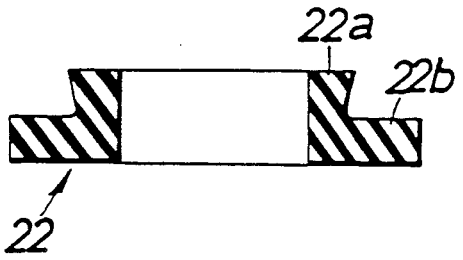

The present invention will now be described by way of embodiments with reference to the accompanying drawings A first embodiment according to the present invention will first be described with reference to FIGS. 1–3. In FIG. 1, a body 1 of an engine is bored with an intake port 4 leading to an intake valve opening 3 which is disposed so as to be exposed to a ceiling surface of a combustion chamber 2. An intake valve 5 is an engine valve opening and closing the intake valve opening 3. Valve 5 is vertically movably guided through a guide cylinder 6 which is provided in the body 1 of the engine. That is, the intake valve 5 comprises a valve shaft portion 5*a* which is slidably passed through the guide cylinder 6, and a valve body portion 5*b* which is capable of opening and closing the intake valve opening 3 and provided at a tip end of the valve shaft portion 5*a*. The valve shaft portion 5*a* is vertically driven.

At an upper portion of the body 1 of the engine, a valve operating cam shaft 7 operatively connected to a crankshaft (not shown) is rotatably disposed around an axis perpendicular to a direction of the valve shaft portion 5*a* of the intake valve 5. The valve operating cam shaft 7 is integrally provided with a cam 8 comprising a circular base portion 8*a* corresponding to a valve-closing timing of the intake valve 5 and a lobe portion 8*b* corresponding to a valve-opening timing of the valve 5.

A support shaft 9 having an axis parallel to the valve operating cam shaft 7 is fixedly disposed between the valve shaft portion 5*a* of the intake valve 5 and the cam shaft 7. A rocker arm 12 as a driving member is interposed between the valve shaft portion 5*a* of the intake valve 5 and the cam 8, and an intermediate portion of the rocker arm 12 is swingably supported around the support shaft 9. One end portion of the rocker arm 12 slide contacts with the cam 8, and a bearing 11 for slide contacting with a rear end of the valve shaft portion 5*a* of the intake valve 5 is pivotally supported at the other end portion of the rocker arm 12.

A sleeve 10 is fixed to the upper portion of the body 1 of the engine at a position corresponding to the intake valve 5. The sleeve 10 is bored with a bottomed sliding bore 10*a* which is opened upwardly and is coaxial with the valve shaft portion 5*a*, and the sliding bore 10*a* is provided at its bottom portion with a guide hole 10*b* through which that portion of the valve shaft portion 5*a* which is projected upwardly from the guide cylinder 6 is movably passed.

Further, secured with a portion of the valve shaft portion 5*a* closer to the rear end thereof is a piston 16 which is slidably fitted in the sliding bore 10*a* via a seal member 14 made of elastic material while forming an air pressure chamber 13 between the piston 16 and the bottom portion of the sliding bore 10*a*. The piston 16 comprises an outer cylindrical portion 16*a*, an inner cylindrical portion 16*b* disposed coaxially with the outer cylindrical portion 16*a* and a connecting flat plate portion 16*c* connecting between one ends of the outer and inner cylindrical portion 16*a* and 16*b*, and is formed into a bottomed double cylindrical shape. The piston 16 is fitted in the sliding bore 10*a* with the connecting plate portion 16*c* being located axially outwardly. Furthermore, an annular groove 17 is provided in a portion of the outer cylindrical portion 16*a* closer to the other end thereof, i.e., in an outer surface of the piston 16 closer to an opening end thereof, and a seal member 14 is fitted in the annular groove 17.

An annular engaging groove 18 is provided in a portion of the valve shaft portion 5*a* closer to its rear end, and the piston 16 is fixed to the portion of the valve shaft portion 5*a* closer to its rear end via a slit cotter doublecut 19 which is engaged with the engaging groove 18. In particular, the inner cylindrical portion 16*b* of the piston 16 is provided with a through hole 20 which is tapered toward the air pressure chamber 13, and an outer surface of the cotter 19 is also formed tapered toward the air pressure chamber 13. Thus, the piston 16 is coaxially fixed to the valve shaft portion 5*a* by pressing the cotter 19 which is engaged with the engaging groove 18 into the through hole 20 from upward.

Meanwhile, in order to prevent air in the air pressure chamber 13 from leaking out from between the guide hole 10*b* and the valve shaft portion 5*a* as well as from the jointed surfaces of the body 1 of the engine and the sleeve 10, an O-ring 21 surrounding the guide cylinder 6 is interposed between the jointed surfaces of the body 1 of the engine and the sleeve 10. Further, in order to prevent air in the air pressure chamber 13 from leaking out from between the cotter 19 and an outer surface of the valve shaft portion 5*a* and between the cotter 19 and an inner surface of the through hole 20, a valve shaft seal member 22 is fitted to an inner end of the inner cylindrical portion 16*b*of the piston 16. As shown in FIG. 2, the seal member 22 is made of elastic material, and comprises a cylindrical portion 22*a* formed in a substantially cylindrical shape for allowing the valve shaft portion 5*a* to pass through the cylindrical portion 22*a* while tightly contacting with the outer surface of the valve shaft portion 5*a*, and a flange portion 22*b* integrally and radially projected from an end portion, of the cylindrical portion 22*a*, closer to the side of the air pressure chamber 13. Also, an outer peripheral surface of the cylindrical portion 22*a* is tapered toward the flange portion 22*b* so as to correspond to the through hole 20.

Figure 3:
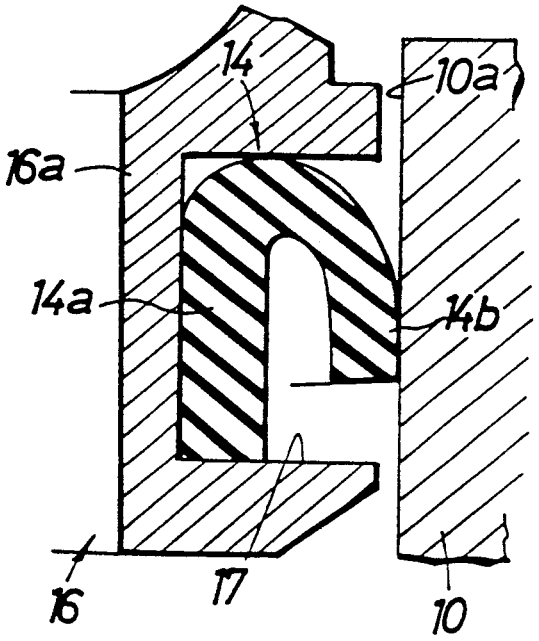

In FIG. 3, the seal member 14 fitted in the annular groove 17 provided in an outer surface of the outer cylindrical portion 16*a* of the piston 16 is substantially formed in a U-shape in cross section opened to the air pressure chamber, and comprises a support portion 14*a* which is substantially formed in an L-shape in cross section and fitted in the annular groove 17, and a lip portion 14*b* which is connected at its small diameter end with the support portion 14*a* and is formed so as to become larger in diameter as heading downward so that the outermost periphery of the lip portion 14*b* slide contacts with the inner surface of the sliding bore 10*a* upon receipt of pressure in the air pressure chamber 13.

Further, a pressurized air supply source 25 is connected to the air pressure chamber 13 through a duct line 24 having a check valve 23. The check valve 23 is arranged so that it allows the air flow only from the pressurized air supply source 25 to the air pressure chamber 13 in response to the reduction of the air pressure in the air pressure chamber 13 to less than that in the pressurized air supply source 25 for more than a predetermined value. For example, the pressurized air of 5 $kg/cm^2$ is supplied from the pressurized air supply source 25, and the check valve 23 is opened when the pressure in the air pressure chamber 13 is reduced to 4 $kg/cm^2$ or less.

Further, a relief valve 30 is connected to the air pressure chamber 13 through a relief passage 29 bored in the sleeve 10. The relief valve 30 is set to be opened at a valve opening pressure (e.g. 16 $kg/cm^2$) which corresponds to the maximum pressure in the air pressure chamber 13 when a predetermined amount of the lubricant oil has gathered in the chamber 13. And the relief passage 29 is bored in the sleeve 10 at a position lower than an oil level l of the lubricant oil which has gathered in the air pressure chamber 13 to the predetermined amount, but higher than the guide bore 10*b*, so as to be communicated to the air pressure chamber 13.

The relief valve 30 is disposed in the sleeve 10 so as to be interposed between the relief passage 29 and the passage 31 which is bored in the sleeve 10 and opened to an outside surface of the sleeve 10. The relief valve 30 comprises a spherical valve body 32 capable of bringing into and out of the communication between the relief passage 29 and the passage 31, and a spring 33 for biasing the valve body 32 in a valve-closing direction.

The sleeve 10 has a recess at a central bottom portion thereof. The valve shaft portion 5*a*, passses through the guide bore 10*b* and projects into the air pressure chamber 13.

Next, the operation of this illustrated embodiment will be described hereinafter. When the valve operating cam 7 is rotated by the crankshaft, the rocker arm 12 is swung by the slide contact of the one end portion of the arm 12 with the cam 8. When the one end portion of the arm 12 slide contacts with the lobe portion 8*b* of the cam 8, the valve shaft portion 5*a* is pressed downwardly through the bearing 11 and the intake valve 5 is opened.

At that time, the piston 16 fixed to the rear end portion of the valve shaft portion 5*a* is also pressed downwardly while compressing the volume of the air pressure chamber 13, and thereby the air pressure is generated in the chamber 13. This causes the intake valve 5 to be biased upwardly, i.e., in a valve-closing direction by the air pressure, and the cam 8 opens the intake valve 5 against the biasing force in the valve-closing direction by the air pressure. Therefore, when the cam 8 is rotated to a position where the circular base portion 8*a* slide contacts with the rocker arm 12, the piston 16 is raised by the air pressure in the air pressure chamber 13 so that the one end of the rocker arm 12 slide contacts with the circular base portion 8*a*, and the intake valve 5 is closed.

By the arrangement where the intake valve 5 is biased in the valve-closing direction by the air pressure in the above described manner, since it is not necessary to take into account the resonance limit by the natural frequency, it is possible to drive the engine at a higher speed, as compared with the art where the intake valve is biased in the valve-closing direction by a valve spring.

Further, by such a valve operating system, the rocker arm 12 presses the valve shaft portion 5*a* downwardly through the bearing 11, and the bearing 11 does not apply to the valve shaft portion 5*a* a force in a direction perpendicular to an axial direction thereof. Thus a force applied from the piston 16 to the sleeve 10 is suppressed in a low level, and thus, it is not necessary to set a strength of the sleeve 10 to a particularly large level.

Also, since the piston 16 is formed in a bottomed double cylindrical shape, a part of the air pressure chamber 13 can be formed within the piston 16. Further, since the seal member 14 is fitted in the outer surface of the piston 16 closer to the opening end thereof, the axial length of the sleeve 10 can be shortened while largely securing the volume of the air pressure chamber 13, contributing to a compactness in a whole structure.

Further, the valve shaft seal member 22 is mounted to the through hole 20 of the piston 16 in such a manner that the cylindrical portion 22*a* which is substantially cylindrically formed so as to correspond to the through hole 20 is resiliently fitted into the inner end of the inner cylindrical portion 16*b* from the side of the air pressure chamber 13. Therefore, the connecting and disconnecting operation of the seal member 22 is easy. Moreover, since there is no need to provide a mounting portion having a special configuration at a side of the piston 16, the arrangement can be simplified, contributing to reductions of the weight and the number of machining steps. Also, the valve shaft seal member 22 exerts a resilient force in its mounted state to the piston 16, and can hold the piston 16 at the valve shaft portion 5*a*, the pressing operation of the cotter 19 into the through hole 20 becomes easy when assembling. Further, since the flange portion 22*b* is tightly contacted with the inner end of the inner cylinder portion 16*b* by the air pressure in the air pressure chamber 13, the valve shaft seal member 22 exerts a sufficient sealing effect.

Meanwhile, since the seal member fitted in the outer surface of the piston 16 is substantially formed in a U-shaped in cross section opened toward the air pressure chamber 13, and the outermost periphery of the lip portion 14*b* is slide contacted with the inner surface of the sliding bore 10*a*, when the piston 16 is depressed, i.e., when the intake valve 5 is opened, the lip portion 14*b* is operated to scrub remove the lubricant oil downwardly, and on the other hand, when the piston 16 raises, i.e., when the intake valve 5 is closed, the lip portion 14*b* is operated to get over the oil film adhering to the inner surface of the sliding bore 10*a*. Thus, the lubricant oil is smoothly supplied to the inner surface of the sliding bore 10*a* and the lubrication between the piston 16 and the inner surface of the sliding bore 10*a* is carried out excellently.

When the lubricant oil which is to be supplied to the portion between the piston 16 and the inner surface of the sliding bore 10*a* is gathering within the oil pressure chamber 13, the maximum pressure in the air pressure chamber 13 rises at the time of the opening of the intake valve 5 is at its maximum. Thus, when the amount of oil gathering in the air pressure chamber 13 exceeds the predetermined level, and the maximum pressure in the chamber 13 exceeds the valve opening pressure of the relief valve 30, the valve 30 is opened. At the time of the opening of the relief valve 30, since the relief passage 29 is communicated to the interior of the air pressure chamber 13 at a position lower than the predetermined lubricant oil level l, such lubricant oil is mainly emitted to the outside through the relief passage 29, the relief valve 30 and the passage 31, and the useless emission of the air in the air pressure chamber 13 can, be avoided.

Since the relief passage 29 is communicated to the interior of the air pressure chamber 13 at a position higher than the guide hole 10*b*, and the recess or concave portion 34 is provided at the central bottom portion of the sliding bore 10*a* at a position also higher than the guide bore 10*b*, the lubricant oil required for lubricating the portion between the valve shaft portion 5*a* and the inner surface of the guide hole 10*b* gathers in the concave portion 34, and the portion between the valve shaft portion 5*a* and the sleeve 10 can sufficiently be lubricated.

Further, if the air in the air pressure chamber 13 is reduced by leakage or the like, the pressurized air is supplied to the air pressure chamber 13 from the pressurized air supply source 25 through the check valve. Hence, the minimum pressure within the air pressure chamber 13 can be maintained and the biasing force which is enough for reliably closing the intake valve 5 can be secured.

Figure 4:
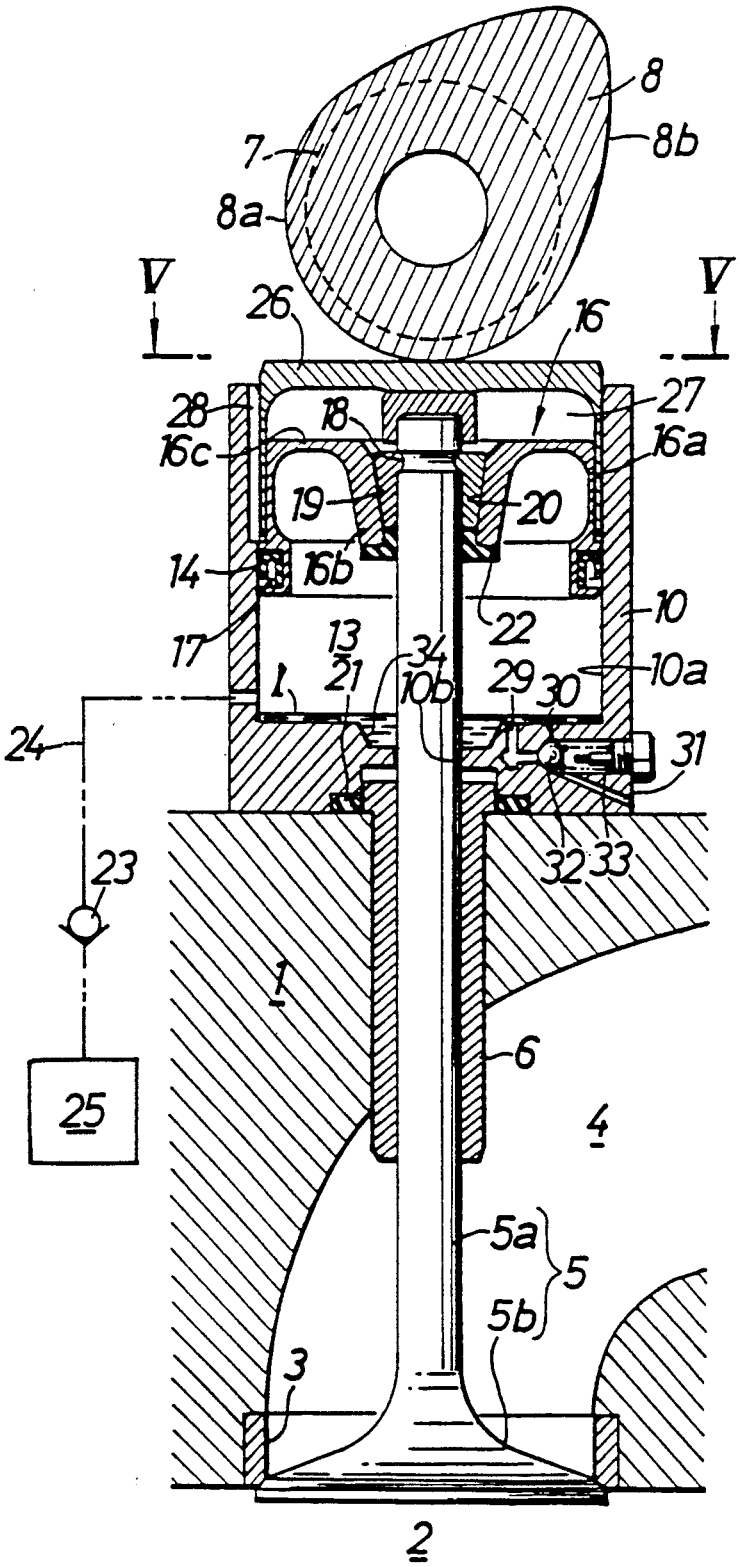
Figure 5:
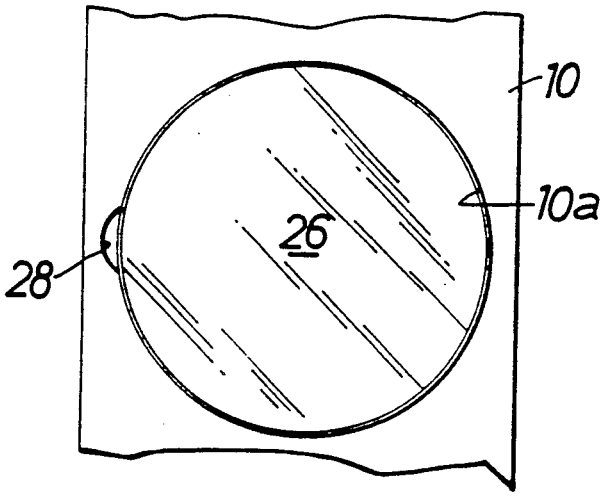

FIGS. 4 and 5 illustrate a second embodiment of the present invention, wherein portions corresponding to those in the previous embodiment are designated by the same reference numerals and characters.

A bottomed cylindrical lifter 26 as a driving member is slidably fitted in an upper portion of the sliding bore 10*a* of the sleeve 10 with a closed end of the lifter 26 being located outwardly. The cam 8 slide contacts with an outer surface of the closed end of the lifter 26, and the inner surface of the closed end of the lifter 26 abuts against the rear end of the valve shaft portion 5*a* of the intake valve 5.

The piston 16 is secured with a portion of the valve shaft portion 5*a* closer to its rear end, and is slidably fitted in the sliding bore 10*a* via the seal member 14. Also, the piston 16 is inserted into the lifter 26 while forming an air chamber 27 between the piston 16 and the lifter 26. Further, an outer diameter of an outer cylindrical portion 16*a* of the piston 16 is set such that a minute annulus or clearance is formed between the inner surface of the lifter 26 and the portion 16*a*.

The inner surface of the sliding bore 10*a* is provided with a communication groove 28 which is axially extended so that an upper end of the groove 28 is communicated with the outside. The location of a lower end of the communication groove 28 is set so that when the circular base portion 8*a* of the cam 8 is slide contacted with the lifter 26 and the intake valve is in its closing state, i.e., when the piston 16 is at its uppermost position, the lower end of the communication groove 28 is located above the seal member 14 to be communicated to the air chamber 27 through the minute annulus between the lifter 26 and the piston 16.

In this second embodiment, the intake valve 5 depresses the piston 16 downwardly to be opened in response to the lifter 26 being pressed downwardly by the cam 8.

Figure 6:
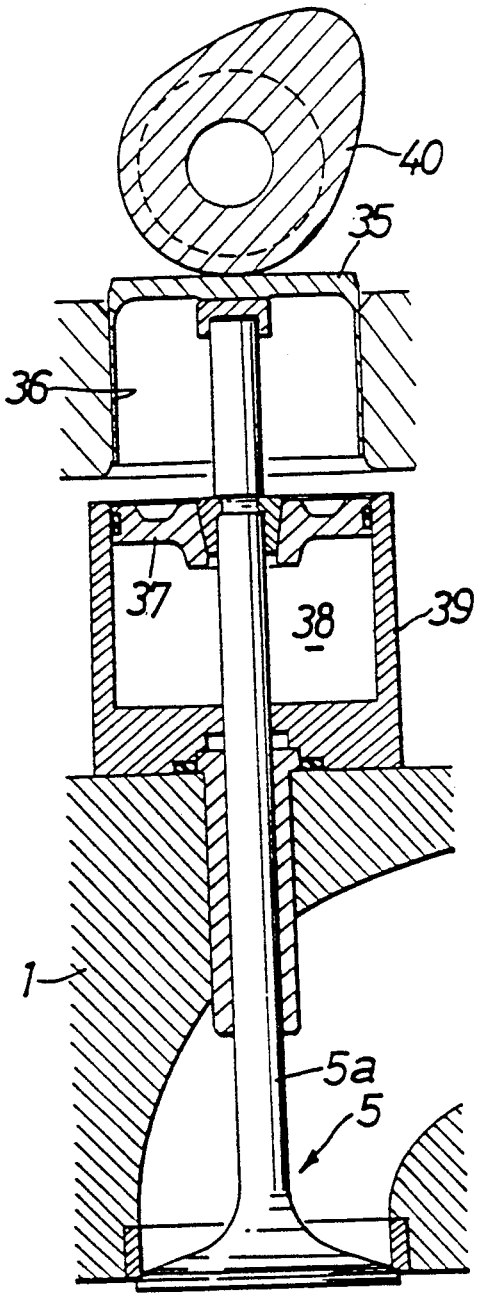
FIG.6 PRIOR ART
FIG. 6 is a longitudinal sectional side view of a prior art.

Further, since in the sliding bore 10*a* of the sleeve 10 in which the piston 16 is fitted, the lifter 26 is also slidably fitted, there is no need to provide above the intake valve 5 an arrangement to guide the lifter 26, this structure together with the arrangement of the piston 16 formed into a bottomed double cylindrical shape can contribute to a compactness in a whole structure, as compared with the prior art of FIG. 6.

Also, when the intake valve 5 is in its closed state, the air chamber 27 is communicated to the outside through the annulus between the lifter 26 and the piston 16 and the communication groove 28, and hence, it can prevent the pressure within the air chamber 27 from abnormally increasing to generate a bouncing and by a float or relief of the lifter 26. It is also possible to release the air from the air chamber 27 when assembling the lifter 26, and at that time, a release of the piston 16 from the valve shaft portion 5*a* by increase of the pressure in the air chamber 27 can be avoided. And when removing the lifter 26, the pressure in the air chamber 27 can be prevented from decreasing by introducing the air into the air chamber 27, and the removing operation becomes easy.

The communication groove 28 also has a function to introduce a part of the lubricant oil which is supposed to be supplied to the sliding surfaces of the cam 8 and the lifter 26, into the sliding bore 10*a* as a lubricant oil between the piston 16 and the inner surface of the sliding bore 10*a*. Thus, the lip portion 14*b* of the seal member 14 fitted in the outer surface of the piston 16 downwardly squeegees or scrubs and removes the lubricant oil which is introduced from the communication groove 28 when the piston 16 is depressed, and the lip portion 14*b* gets over the oil film adhering to the inner surface of the sliding bore 10*a* when the piston 16 raises. Therefore, the lubricant oil is smoothly supplied from the communication groove 28 to the inner surface of the sliding bore 10*a*, and the lubrication between the piston 16 and the inner surface of the sliding hole 10*a* is carried out excellently.

In each of the above embodiments, although the explanation has been made especially based on the intake valve 5 as an engine valve, the present invention is also applicable to the valve operating system of the exhaust valve.

Although several embodiments have been shown and described, it will be apparent to the person skilled in the art that other variations are possible, without departing from the spirit and scope of the present invention. The invention, therefore, should not be limited except as defined in the following claims.

What is claimed is:

1. A valve operating system of an internal combustion engine, comprising:

an engine valve having a valve shaft and a valve body at a tip end of the valve shaft;

said engine valve being supported on an engine body for opening and closing operations while resiliently biased in a valve-closing direction;

a driving member for driving said engine valve in a valve-opening direction operatively connected to a rear end of said valve shaft;

a sleeve fixed to the engine body having a sliding bore with a bottom portion, and a guide hole through which said valve shaft is air-tightly and movably passed;

a double cylindrical piston including inner and outer cylindrical portions fixed at its inner cylindrical portion to the valve shaft adjacent the rear end thereof and slidably fitted at its outer cylindrical portion in said sliding bore through a seal member to form an air pressure chamber between the piston and the bottom portion of the sliding bore;

said seal member positioned in a lower portion of the outer cylindrical portion of the piston; and a cylindrical lifter slidably fitted in said sliding bore above said seal member.

2. A valve operating system of an internal combustion engine, comprising:

an engine valve having a valve shaft and a valve body provided at a tip end of the valve shaft;

said engine valve being supported on an engine body for opening and closing operations while resiliently biased in a valve-closing direction;

a driving member for driving said engine valve in a valve-opening direction operatively connected to a rear end of said valve shaft;

a sleeve fixed to the body of the engine and provided with a sliding bore having a bottom portion and a guide hole through which said valve shaft is air-tightly and movably passed;

a double cylindrical piston fixed to the valve shaft adjacent the rear end thereof, and slidably fitted in said sliding bore through a seal member to form an air pressure chamber between the piston and the bottom portion of the sliding bore; and a relief valve for opening at a valve opening pressure corresponding to a maximum pressure in said air pressure chamber which is achieved when a predetermined amount of lubricant oil has gathered in said air pressure chamber, said relief valve connected to the air pressure chamber through a relief passage in said sleeve and connecting to the interior of the air pressure chamber at a position lower than a level of said predetermined amount of lubricant oil gathered within the air pressure chamber and above said guide hole.

3. A valve operating system of an internal combustion engine, comprising:

an engine valve having a valve shaft and a valve body provided at a tip end of the valve shaft;

said engine valve supported on an engine body for opening and closing operations while resiliently biased in a valve-closing direction;

a driving member for driving said engine valve in a valve-opening direction operatively connected to a rear end of said valve shaft;

a sleeve fixed to the body of the engine having a sliding bore with a bottom portion and a guide hole through which said valve shaft is air-tightly and movably passed;

a double cylindrical piston fixed to the valve shaft adjacent the rear end thereof and slidably fitted in said sliding bore through a seal member to form an air pressure chamber between the piston and the bottom portion of the sliding bore; and a cylindrical lifter slidably fitted in said sliding bore and interposed between said driving member and the rear end of said valve shaft with said piston inserted in said lifter.

4. A valve operating system of an internal combustion engine according to claim 3, wherein a communication groove opening to an outside is formed at an inner surface of the sliding bore such that the communication groove is capable of communicating with a space between said lifter and said piston at a position on that side of the seal member which is close to the lifter.

5. A valve operating system of an internal combustion engine according to claims 2, 3 or 4, wherein said piston has a central tapered through hole having a larger end and a smaller end and receiving a press-fit cotter for fixing said piston to the valve shaft, and further comprising a valve shaft seal member made of elastic material and having a cylindrical portion resiliently fitted to the smaller end of said through hole, and said seal member having a flange portion attached to the cylindrical portion for contact with the central portion of said piston, said seal member disposed between an inner surface of the through hole and an outer surface of the valve shaft portion.

6. A valve operating system of an internal combustion engine according to claim 2, 3 or 4 wherein said seal member is fitted around an outer surface of said piston and is formed into an annular shape with a substantially U-shaped cross section, opening toward said air pressure chamber, and which has a lip portion for sliding contact at an outermost peripheral portion thereof with the inner surface of said sliding bore.

7. A valve operating system of an internal combustion engine according to claim 5, wherein said seal member is fitted around an outer surface of said piston and is formed into an annular shape with a substantially U-shaped cross section which is opened toward said air pressure chamber and which has a lip portion for sliding contact at an outermost peripheral portion thereof with the inner surface of said sliding bore.

* * * * *